US008375681B2

(12) United States Patent
Kim

(10) Patent No.: US 8,375,681 B2
(45) Date of Patent: Feb. 19, 2013

(54) AIR INJECTION APPARATUS FOR BUFFER PACKING BAG AND AIR INJECTION METHOD USING THE SAME

(75) Inventor: Sung Jun Kim, Gunpo-si (KR)

(73) Assignee: INDIS AIR Corp., Seoul (KR)

( * ) Notice: Subject to any disclaimer, the term of this patent is extended or adjusted under 35 U.S.C. 154(b) by 270 days.

(21) Appl. No.: 12/703,432

(22) Filed: Feb. 10, 2010

(65) Prior Publication Data

US 2011/0192114 A1 Aug. 11, 2011

(51) Int. Cl.
*B65B 31/00* (2006.01)

(52) U.S. Cl. ..... 53/79; 53/403; 493/967

(58) Field of Classification Search ..... 53/79, 403; 493/967

See application file for complete search history.

(56) References Cited

U.S. PATENT DOCUMENTS

| | | | | |
|---|---|---|---|---|
| 3,938,298 | A * | 2/1976 | Luhman et al. | 53/403 |
| 4,096,306 | A * | 6/1978 | Larson | 428/192 |
| 4,384,442 | A * | 5/1983 | Pendleton | 53/554 |
| 5,651,402 | A * | 7/1997 | McCaul | 141/314 |
| 5,660,662 | A * | 8/1997 | Testone | 156/145 |
| 6,460,313 | B1 * | 10/2002 | Cooper | 53/79 |
| 7,165,375 | B2 * | 1/2007 | O'Dowd | 53/96 |
| 7,913,474 | B2 * | 3/2011 | Aquarius | 53/403 |
| 2006/0292320 | A1 * | 12/2006 | Greenwood et al. | 428/34.1 |
| 2009/0077926 | A1 * | 3/2009 | Liao et al. | 53/403 |
| 2009/0178372 | A1 * | 7/2009 | Fuss et al. | 53/403 |
| 2010/0251668 | A1 * | 10/2010 | Sperry et al. | 53/403 |

* cited by examiner

*Primary Examiner* — Thanh Truong

(74) *Attorney, Agent, or Firm* — Brian R. Morrison; Westman, Champlin & Kelly, P.A.

(57) ABSTRACT

An air injection apparatus configured to inject air into a buffer packing bag.

9 Claims, 8 Drawing Sheets

AIR INJECTION APPARATUS FOR BUFFER PACKING BAG AND AIR INJECTION METHOD USING THE SAME

BACKGROUND

1. Field of the Invention

The present invention relates to an air injection apparatus configured to inject air into a buffer packing bag, and more particularly to such an air injection apparatus which can more conveniently implement a process of injecting air into a buffer packing bag.

2. Description of the Related Art

A buffer packing bag has an air injection passage formed in a lengthwise or width direction thereof and air-inflatable columns formed in a direction perpendicular to the air injection passage. Also, check valves are formed at the individual air-inflatable columns to close the individual air-inflatable columns in order to prevent the reverse flow of air back to the air injection passage after the air injected into the air injection passage is introduced into the multiple individual air-inflatable columns.

In the meantime, conventionally, a small-diameter tube is fitted into the air injection passage so as to inject air into the buffer packing bag. During the injection of the air, a user tightly grasps the air injection passage into which the tube is fitted with his or her hand so as to prevent air injected into the buffer packing bag from being discharged back to the outside, thereby interrupting the discharge of the air.

In this manner, conventionally, a process of injecting air into the buffer packing bag has been mainly performed manually. Thus, such a conventional air injection method entails a problem in that the air injection rate is low as well as ordinary persons other than experts inject air in an excessive or small amount, thereby leading to inferior quality of the buffer packing bag.

Especially, since vinyl sheets constituting the buffer packing bag adhere closely to with each other in a state where air is not injection into the buffer packing bag, a user has a difficulty in finding out and widening an entrance opening of the air injection passage in order to insert the small-diameter tube into the buffer packing bag.

In addition, in the case where the injection of the air into the buffer packing bag is completed and then the air filled into the multiple individual air-inflatable columns is finely discharged to the outside through the air injection passage, the air leaks to the outside without any resistance through the air injection passage, disadvantageously resulting in deterioration of durability of the buffer packing bag.

SUMMARY

Accordingly, the present invention has been made to solve the above-mentioned problems occurring in the prior art, and it is an object of the present invention to provide an air injection apparatus for a buffer packing bag, which is configured to allow a worker to inject air into a buffer packing bag through a mechanical mechanism even without performing any other manipulations except grasping an air injection passage of the buffer packing bag, and an air injection method using the same.

Another object of the present invention is to provide an air injection apparatus for a buffer packing bag, which is configured such that an entrance opening of an air injection passage of the buffer packing bag is closed so that even though air filled into air-inflatable columns of the buffer packing bag escapes to the air injection passage, the air is prevented from leaking to the outside via the air injection passage, thereby enhancing durability, and an air injection method using the same.

To achieve the above object, in one aspect, the present invention provides an air injection apparatus for a buffer packing bag, including: a nozzle adapted to be inserted into an entrance opening of an air injection passage of the buffer packing bag positioned at a front side of the air injection apparatus so as to inject air into the entrance opening of the air injection passage; a clamp adapted to pressurize the entrance opening of the air injection passage in a state where the nozzle has been inserted into the entrance opening of the air injection passage so as to prevent the air from leaking to the outside via the entrance opening; and a second actuator adapted to driven to cause the clamp to pressurize the entrance opening of the air injection passage.

Also, according to a preferred embodiment of the present invention, the nozzle is connected to a first actuator so that it is moved forwardly and backwardly by means of the operation of the first actuator.

In addition, according to a preferred embodiment of the present invention, the air injection apparatus further includes: a heater adapted to pressurize and heat-bond the entrance opening of the air injection passage; and a third actuator adapted to move the heater to the entrance opening of the air injection passage.

Besides, according to a preferred embodiment of the present invention, the clamp has a groove formed on the bottom surface thereof, so that when the entrance opening of the air injection passage is pressurized by the clamp, the nozzle is positioned in the groove, and any one of the vinyl sheets of the air injection passage is clamped between the nozzle and the clamp.

Moreover, according to a preferred embodiment of the present invention, the air injection apparatus further includes: a bottom portion on which the second actuator (160) is positioned; a fixed block positioned in front of the second actuator; and a first lever mounted at a front end thereof to the clamp and mounted at a rear end thereof to the second actuator, the first lever being coupled at an intermediate portion thereof to the fixed block by means of a hinge pin.

Further, according to a preferred embodiment of the present invention, the nozzle is connected to a first actuator so that it is moved forwardly and backwardly by the operation of the first actuator, the first actuator is mounted on the bottom portion so as to be connected to a slide block movable forwardly and backwardly, the nozzle is fixedly mounted to the slide block, and a first coupler for connection of a hose is fixedly mounted to the rear end of the nozzle.

Also, according to a preferred embodiment of the present invention, a guide rail is fixedly mounted to the fixed block while penetrating through the slide block, so that the slide block is moved forwardly and backwardly along the guide rail.

In addition, according to a preferred embodiment of the present invention, the air injection apparatus further includes: a heater adapted to pressurize and heat-bond the entrance opening of the air injection passage; a third actuator adapted to move the heater to the entrance opening of the air injection passage, the third actuator being mounted on the bottom portion; and a second lever mounted at a front end thereof to the heater and mounted at a rear end thereof to the third actuator, the second lever 172 being coupled at an intermediate portion thereof to the fixed block by means of a hinge pin.

Besides, according to a preferred embodiment of the present invention, the bottom portion is coupled to the hinge bracket positioned therebelow by means of a hinge pin so that a front end of the bottom portion pivots in a vertical direction about the hinge pin.

Moreover, according to a preferred embodiment of the present invention, the bottom portion is surrounded by a case having a plurality of angle adjustment holes formed on a side thereof, and the hinge bracket has a female screw hole formed on a side thereof to correspond to any one of the plurality of angle adjustment holes of the case, so that an angle adjustment bolt is engaged with the female screw hole of the hinge bracket while passing through the any one angle adjustment hole.

Further, according to a preferred embodiment of the present invention, a guide rail is fixedly mounted at a front end thereof to a stopper while penetrating through the fixed block, and a screw is engaged with a side of the fixed block so as to restrict the movement of the guide rail to determine the position of the stopper.

To achieve the above object, in another aspect, the present invention provides an air injection method using an air injection apparatus for a buffer packing bag, the air injection method including the steps of: injecting air toward an entrance opening of an air injection passage of the buffer packing bag positioned in front of a nozzle so as to open the entrance opening of the air injection passage; inserting the nozzle into the opened entrance opening of the air injection passage so as to allow the air to be injected into the air injection passage; clamping vinyl sheets of the air injection passage in a state where the nozzle has been inserted into the air injection passage so as to prevent the air injected into the air injection passage from leaking to the outside of the air injection passage; and withdrawing the nozzle, when air is filled into the buffer packing bag, from the air injection passage.

Also, according to a preferred embodiment of the present invention, the air injection method further includes heat-bonding the entrance opening of the air injection passage to sealingly close the entrance opening of the air injection passage prior to the step of withdrawing the nozzle from the air injection passage.

BRIEF DESCRIPTION OF THE DRAWINGS

The above and other objects, features and advantages of the present invention will be apparent from the following detailed description of the preferred embodiments of the invention in conjunction with the accompanying drawings, in which.

Figure 1:
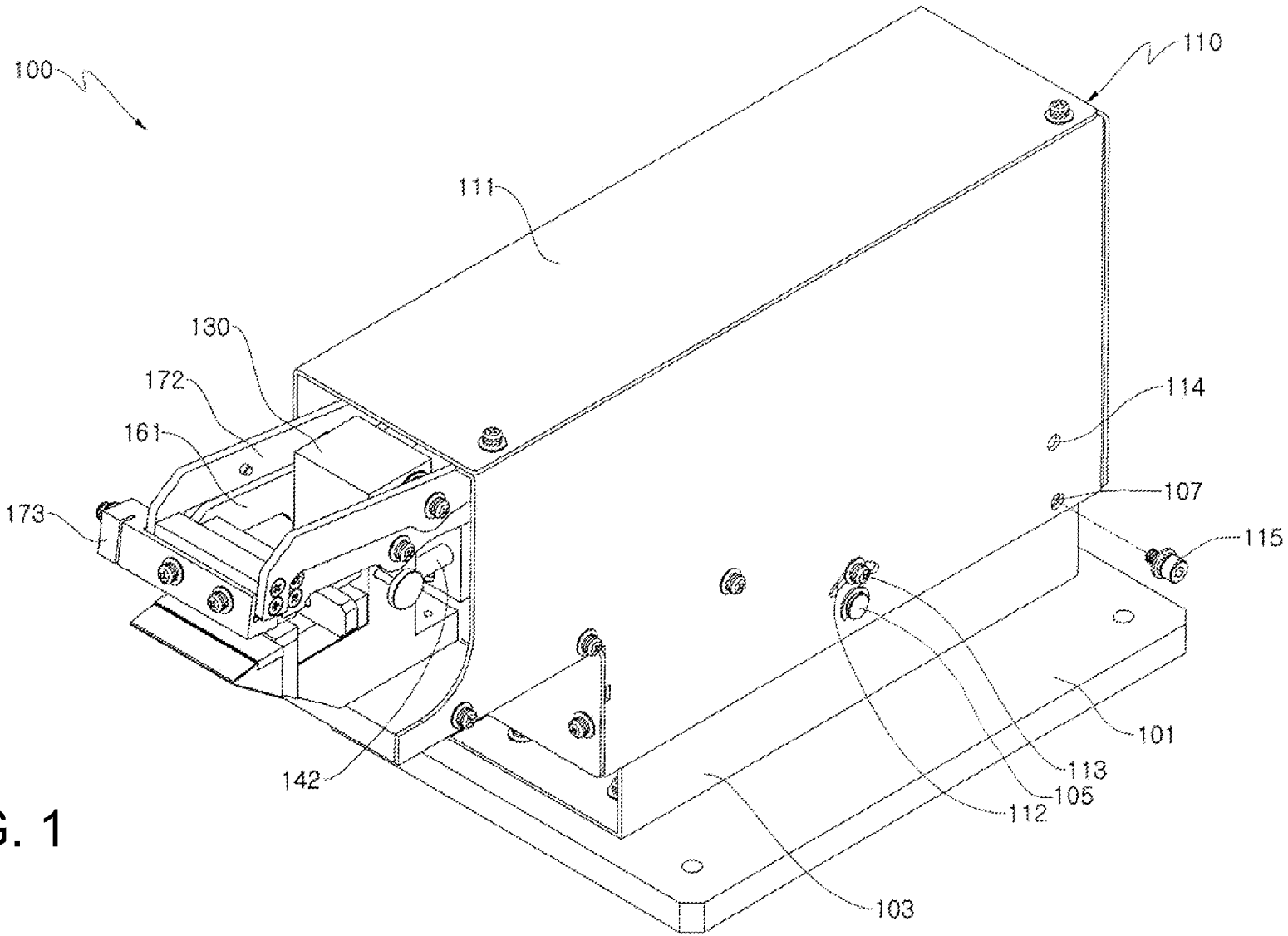
FIG. 1 is a top perspective view illustrating an air injection apparatus for a buffer packing bag according to the present invention.

Reference numerals set forth in the drawings includes reference to the following elements as further discussed below:

1: buffer packing bag
3: air injection passage
**3*v***: vinyl sheet
100: air injection apparatus
101: base plate
103: hinge bracket
105: hinge pin
107: female screw hole
110: main body
111: case
112: slot
113: bolt
114: angle adjustment hole
115: angle adjustment bolt
117: bottom portion
120: nozzle
121, 182, 183: coupler
123: first guide rail
130: fixed block
140: stopper
142: second guide rail
143: screw
150, 160, 170: actuator
151: slide block
161, 172: lever
163: clamp
165, 175: support
173: heater
180: power supply
181: connector
190: controller
191: pressure gauge
193: timer
195: start button
197: reset button

DETAILED DESCRIPTION

Hereinafter, a preferred embodiment of air injection apparatus for a buffer packing bag according to the present invention will be described in further detail with reference to the accompanying drawings.

Figure 2:
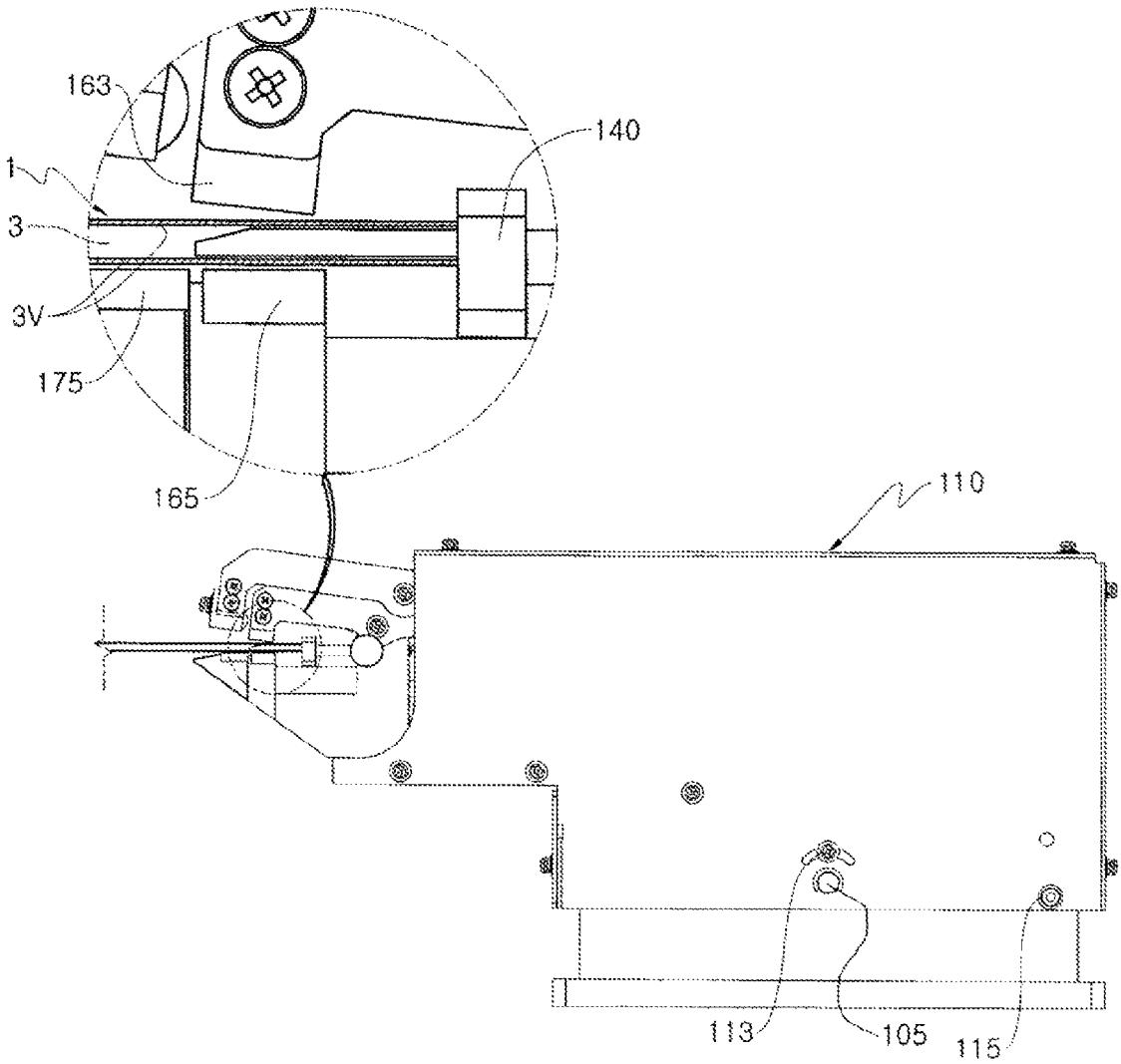
FIG. 2 is a side view illustrating a state in which a buffer packing bag is moved into the air injection apparatus shown in FIG. 1.
Figure 3:
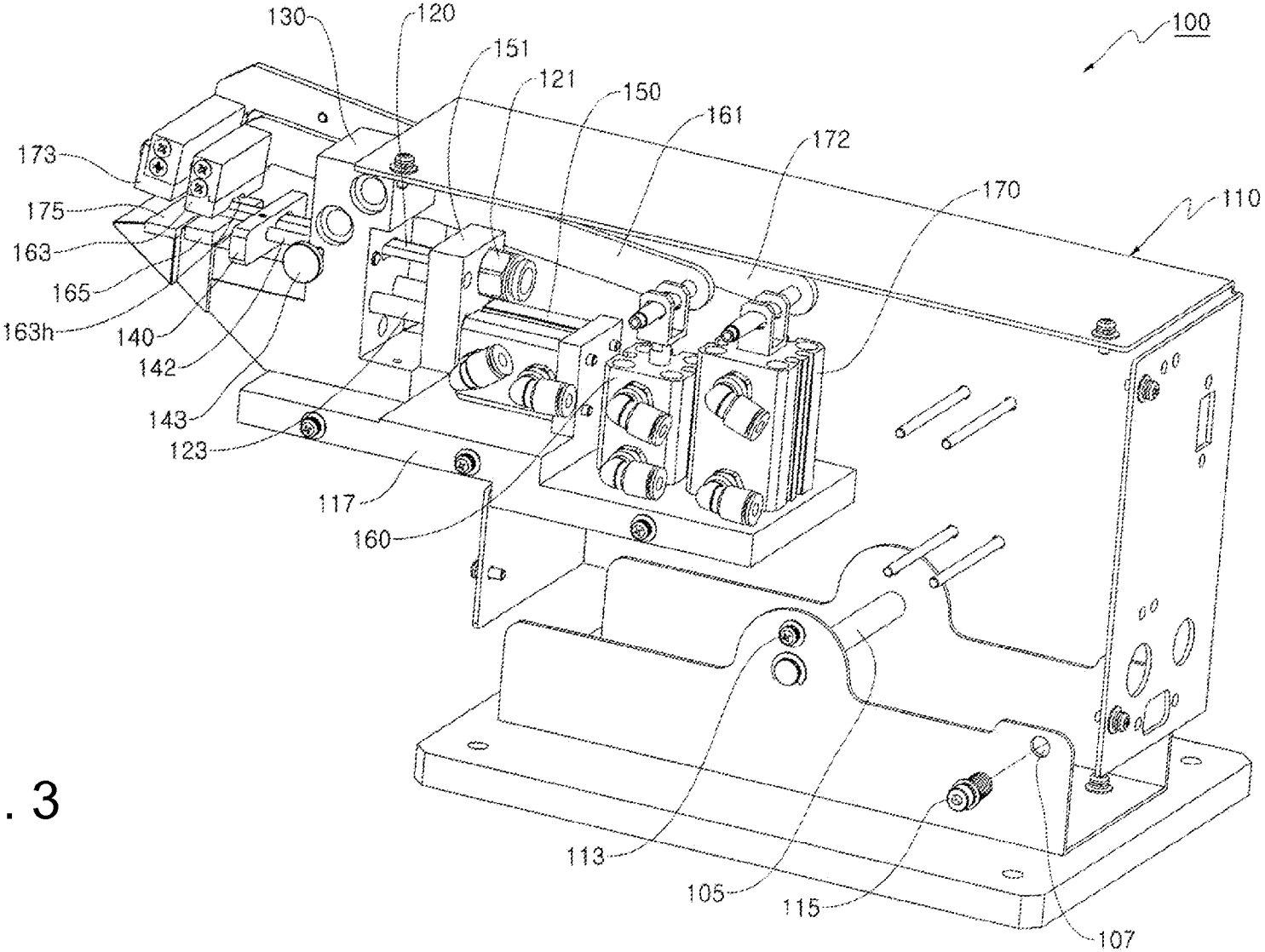
FIG. 3 is a top perspective view illustrating the inner construction of the air injection apparatus shown in FIG. 1.
Figure 4:
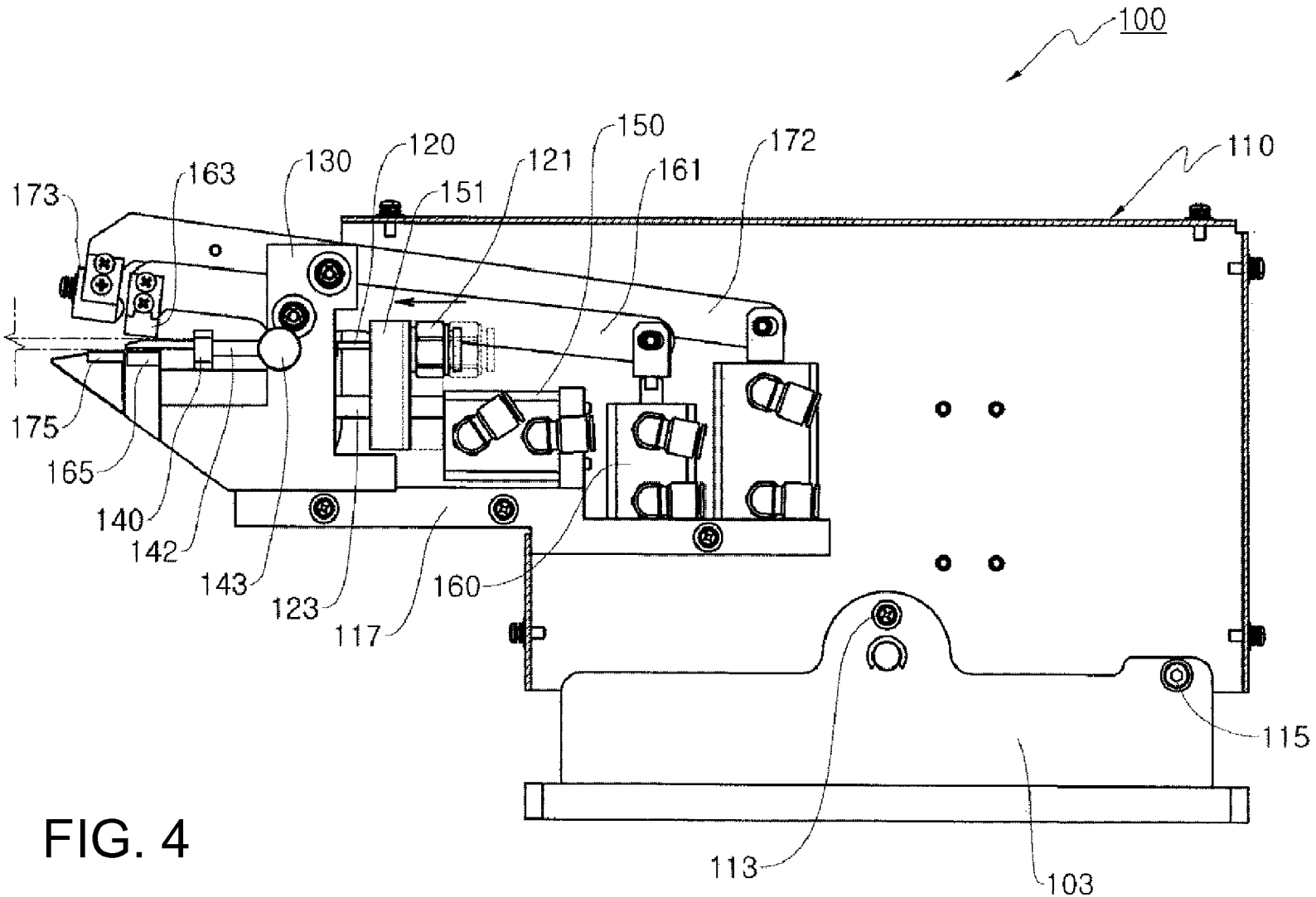
FIG. 4 is a schematic view illustrating the operational relationship of a nozzle according to the operation of a first actuator shown in FIG. 3.
Figure 5:
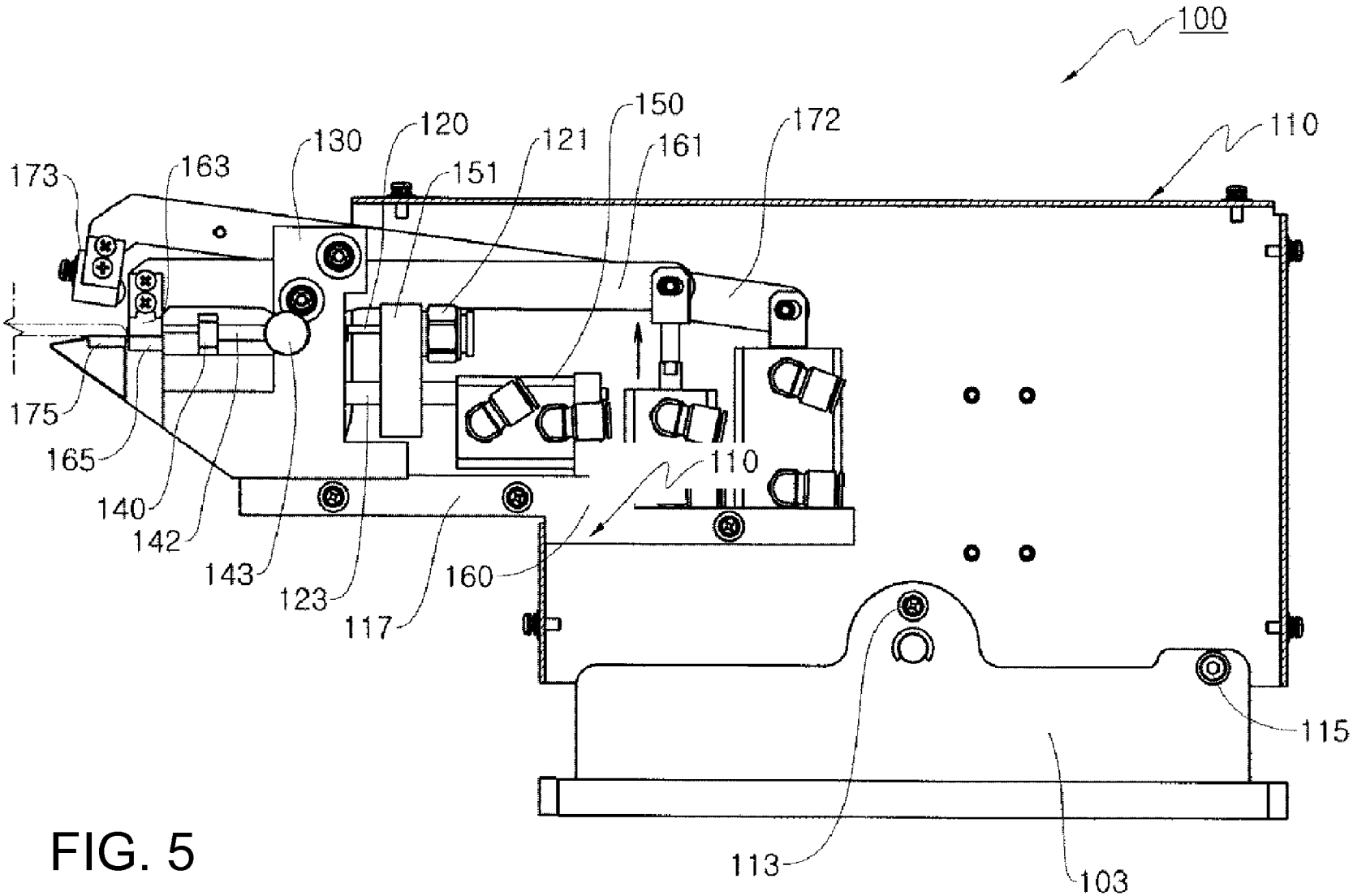
FIG. 5 is a schematic view illustrating the operational relationship of a clamp according to the operation of a second actuator shown in FIG. 3.
Figure 6:
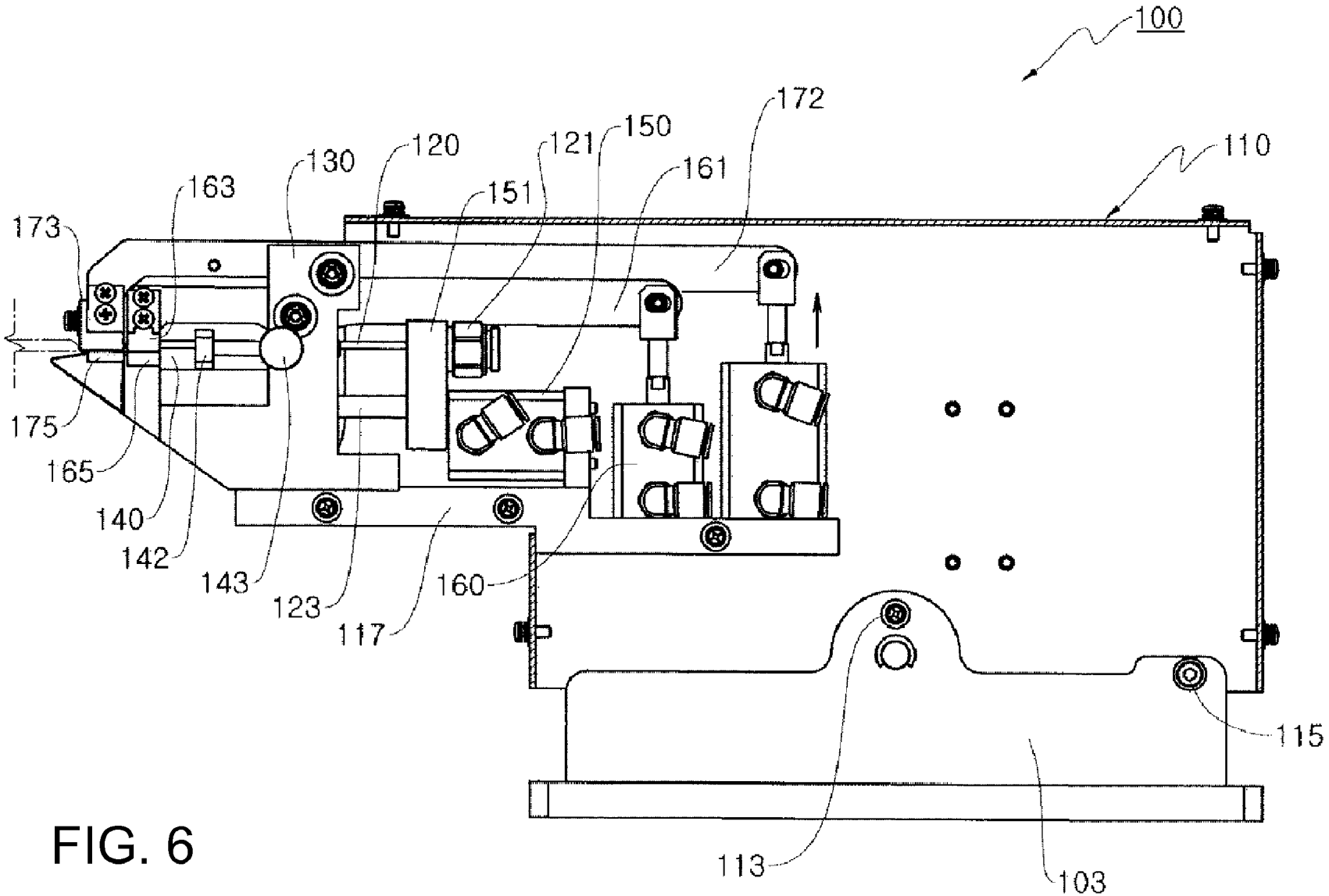
FIG. 6 is a schematic view illustrating the operational relationship of a heater according to the operation of a third actuator shown in FIG. 3.
Figure 7:
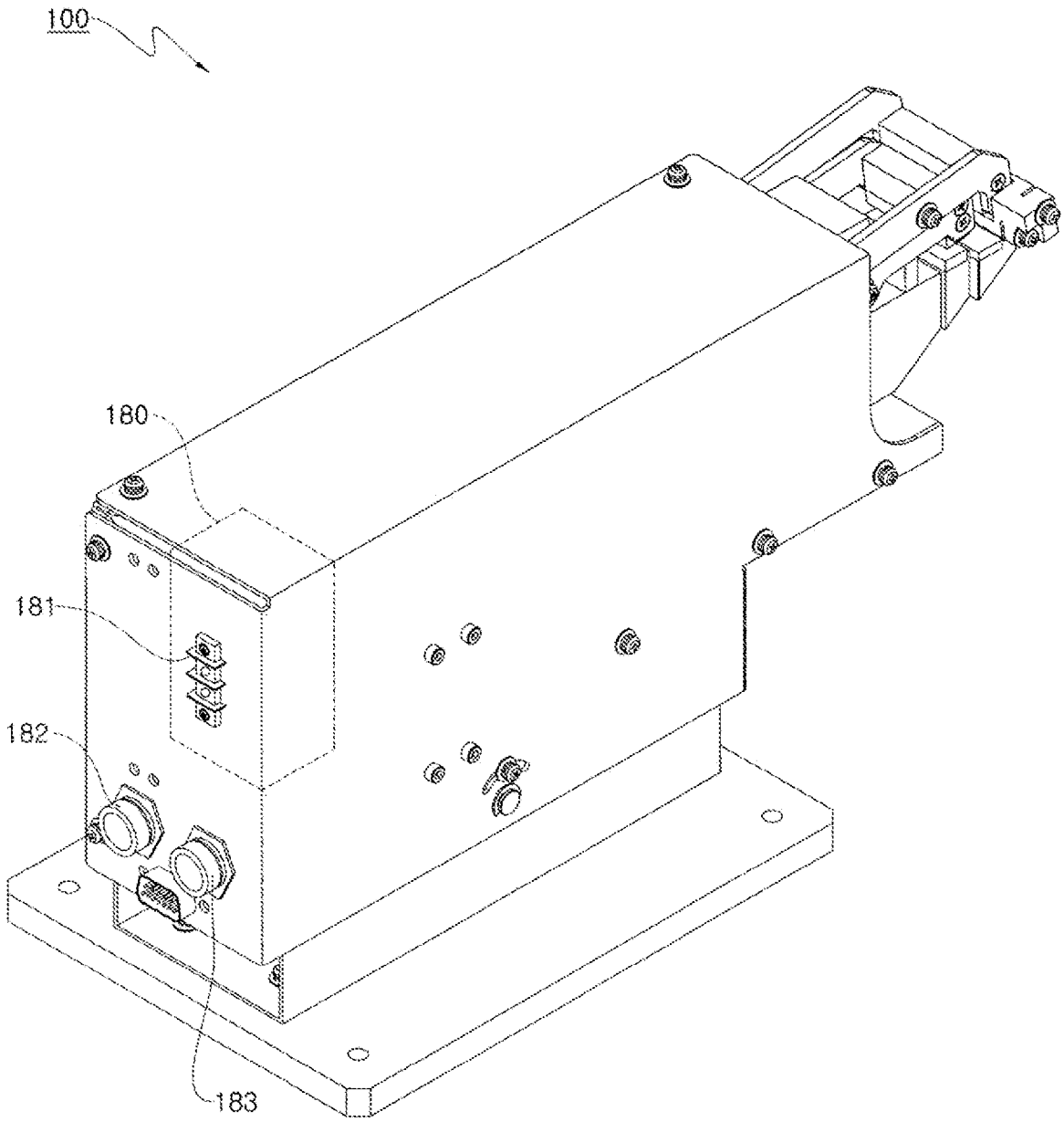
FIG. 7 is a top perspective view illustrating an air injection apparatus according to the present invention when viewed from the rear side.
Figure 8:
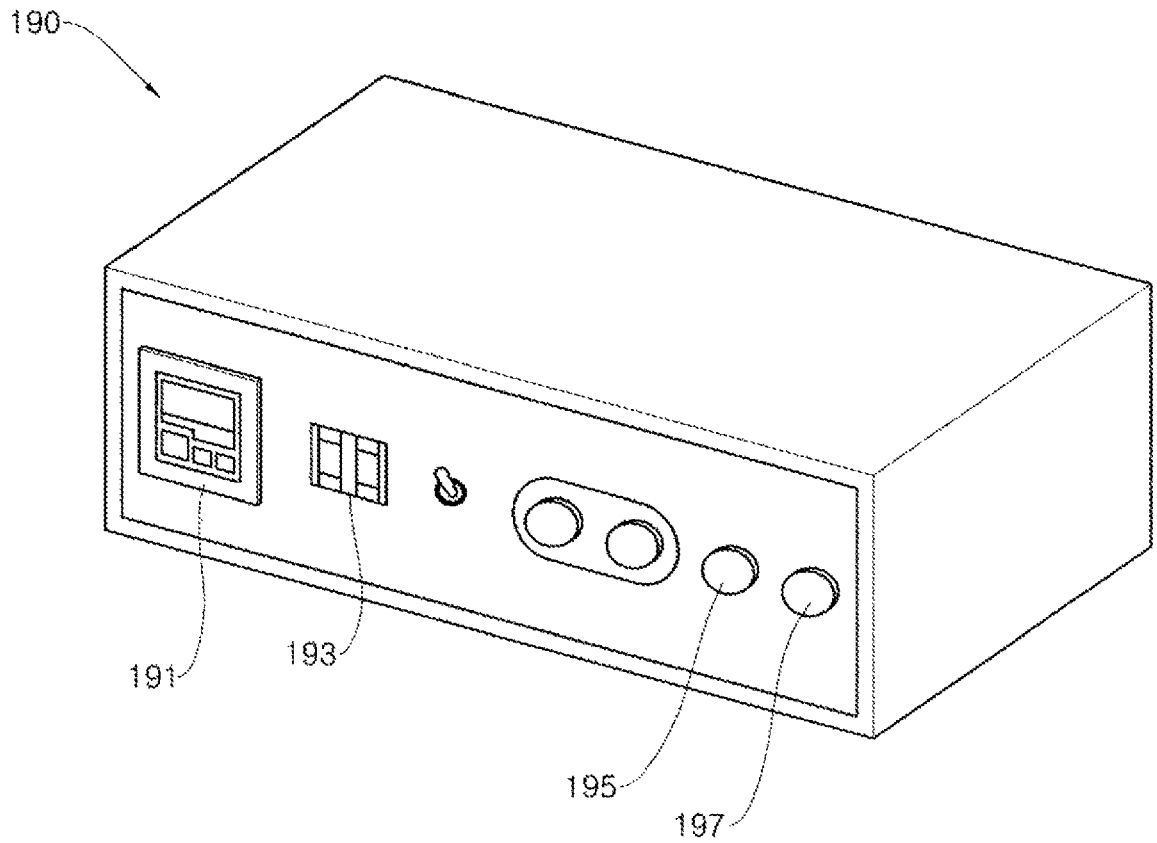
FIG. 8 is a top perspective view illustrating a controller.

FIG. 1 is a top perspective view illustrating an air injection apparatus for a buffer packing bag according to the present invention, FIG. 2 is a side view illustrating a state in which a buffer packing bag is moved into the air injection apparatus shown in FIG. 1, FIG. 3 is a top perspective view illustrating the inner construction of the air injection apparatus shown in FIG. 1, FIG. 4 is a schematic view illustrating the operational relationship of a nozzle according to the operation of a first actuator shown in FIG. 3, FIG. 5 is a schematic view illustrating the operational relationship of a clamp according to the operation of a second actuator shown in FIG. 3, FIG. 6 is a schematic view illustrating the operational relationship of a heater according to the operation of a third actuator shown in FIG. 3, FIG. 7 is a top perspective view illustrating an air injection apparatus according to the present invention when viewed from the rear side, and FIG. 8 is a top perspective view illustrating a controller.

As shown in FIGS. 1 and 2, the air injection apparatus 100 includes: a nozzle 120 adapted to be inserted into an entrance opening of an air injection passage 3 of the buffer packing bag 1 positioned at a front side of the air injection apparatus so as to inject air into the entrance opening of the air injection passage; a clamp 163 adapted to pressurize the entrance opening of the air injection passage in a state where the nozzle 120 has been inserted into the entrance opening of the air injection passage 3; a second actuator 160 adapted to driven to cause the clamp 163 to pressurize the entrance opening of the air injection passage 3; and a compressor (not shown) connected to the nozzle 120 so as to supply compressed air to the nozzle. The overall operation of the air injection apparatus 100 is controlled by the controller 190.

When a worker inputs a signal through the controller 190 in a state where the air injection passage 3 of the buffer packing bag 1 is positioned at an entrance of the clamp 163 of the air injection apparatus 100, the nozzle 120 is moved to the front side of the air injection apparatus 100, i.e., to the air injection passage 3 of the buffer packing bag 1 by means of the operation of the first actuator 150 so that the compressed air blown from the compressor connected to the nozzle is injected through the nozzle 120. Then, the air injected from the nozzle 120 opens the air injection passage 3, and the worker moves the buffer packing bag 1 to the nozzle 120 after checking that the nozzle 120 has been advanced to the air injection passage 3 so as to cause the nozzle 120 to be inserted into the air injection passage 3.

Thereafter, the clamp 163 is operated to clamp the air injection passage 3 into which the nozzle 120 is inserted so that the buffer packing bag 1 is not flown by the compressed air injected from the nozzle 120. Also, the air injected into the buffer packing bag 1 through an entrance opening of the air injection passage 3 is prevented from being discharged back to the outside so as to allow the injected air to be filled into the buffer packing bag 1 without any leakage.

The air injection apparatus for a buffer packing bag according to the present invention will be described in more detail hereinafter.

As shown in FIG. 3, the air injection apparatus 100 includes a tilting function for the convenience of manipulation in view of the height of a worker. A main body 110 of the air injection apparatus 100 is constructed to be coupled to a base plate 101 by means of a hinge pin 105. The main body 110 may be positioned horizontally or may be lowered at a rear portion thereof while pivoting about the hinge pin 105 so that a front portion of the main body 110 can be lifted at an angle of about 20°. In such a horizontal or tilted state, a case 110 of the main body 110 has a semi-circular slot 113 formed on a side wall thereof in such a fashion as to be positioned just above the hinge pin 105. A bolt 113 penetrating through the slot 112 is securely fastened to a hinge bracket 103 fixed to a base plate 101. Thus, the interference of the bolt 113 restricts the tilting angle of the main body 111. Also, the case 111 has a plurality of angle adjustment holes 114 formed on a rear portion of the side wall thereof so as to allow an angle adjustment bolt 115 to penetrate therethrough. In this case, the angle adjustment holes 114 are positioned at an angle of about 20° with respect to the hinge pin 105. The hinge bracket has a female screw hole 107 formed on a side thereof so that the angle adjustment bolt 115 penetrates through any one of the angle adjustment holes 114 and is engaged with the female screw hole 107.

Therefore, after the angle adjustment bolt 115 the female screw hole 107 has been disengaged from and the tilting angle of the main body 110 has been adjusted, the angle adjustment bolt 115 is engaged with the female screw hole 107 of the hinge bracket 103 in a state of being fitted into any one angle adjustment hole of the case 111, so that the main body 110 is positioned in a horizontal or 20° tilted state. Here, the hinge pin 105 is fixed at both ends to the hinge bracket 103 with the hinge bracket 103 fixed to the base plate 101.

In the meantime, a bottom portion 117 of the main body 110 can be tilted in a state of being coupled to the hinge bracket 103 mounted to the base plate 101 by means of a hinge pin 105. Three actuators 130, 160 and 170 are mounted on the top surface of the bottom portion 117. The actuators are pneumatic systems. The first actuator 150 can be positioned in a stretchable and retractable manner in a lengthwise direction of the bottom portion 117, and the second actuator 160 and the third actuator 170 can be positioned in a stretchable and retractable manner in a vertical direction with respect to the top surface of the bottom portion 117.

As shown in FIG. 3, a slide block 151 is mounted to the first actuator 150 so that it is moved in a forward and backward direction, i.e., in a lengthwise direction of the main body 110 by means of the first actuator 150. The nozzle 120 is mounted to the slide block 151 so that it is also moved together with the slide block 151 in the forward and backward direction by means of the first actuator 150. As mentioned above, the movement of the nozzle 120 is performed in such a fashion that the nozzle 120 is moved forwardly to be inserted into the air injection passage 3 of the buffer packing bag or is moved backwardly to return to its original position after the completion of injection of the air.

Meanwhile, the second actuator 160 is positioned in the rear of the first actuator 150, and the third actuator 170 is positioned in the rear of the second actuator 160.

Also, as shown in FIGS. 5 and 6, a first lever 161 is connected at a rear end thereof to the second actuator 160, and a second lever 172 is connected at a rear end thereof to the third actuator 170. An intermediate portion of each of the first lever 161 and the second lever 172 is coupled to a fixed block 130 fixed to the bottom portion 117 and positioned in front of the first actuator 150 by means of a hinge pin 105. While the rear ends of the first lever 161 and the second lever 172 pivot in response to the movement of the second actuator 160 and the third actuator 170, the front ends of the first lever 161 and the second lever 172 pivot in a direction opposite to the movement direction of the second actuator 160 and the third actuator 170.

Here, the clamp 163 is fixedly mounted to the front end of the first lever 161, and the heater 173 is fixedly mounted to the front end of the second lever 172.

In the meantime, the slide block 151 is moved in the forward and rearward directions on the top surface of a lower portion thereof, and a first guide rail 123 is fixedly mounted to the fixed block 130 while penetrating through the slide block 151. Thus, the slide block 151 is moved along the first guide rail 123 in forward and rearward directions in response to the movement of the first actuator 150. In this manner, as the slide block 151 is moved along the two first guide rail 123, the advancement direction of the nozzle 120 can be maintained constantly. If the advancement direction of the slide block 151 is not constant, the advancement direction of the nozzle 120 fixed to the slide block 151 also is not constant. As a result, the nozzle 120 is not correctly inserted into the air injection passage 3 of the buffer packing bag 1 positioned below the clamp 163.

Meanwhile, the nozzle 120 is constructed such that its length is larger than its width and is hollow internally. The nozzle 120 is fixedly mounted to the slide block 151 in a state of penetrating through the slide block 151. Also, a first coupler 121 for connection of a hose is fixedly mounted to the rear end of the nozzle 120 extending in a backward direction of the slide block 151. The front end of the nozzle 120 is oriented toward the camp 163.

In the meantime, the nozzle 120 extends toward the clamp 163 from the slide block 151 while penetrating through the fixed block 130. In addition, the nozzle 120 passes through a stopper 140 positioned in front of the fixed block 130.

The second guide rail 142 is fixedly mounted at a front end thereof to the stopper 140 while penetrating through the fixed block 130. Also, a screw 143 is engaged with a side of the fixed block 130 so as to pressurize the second guide rail 142. Thus, when the screw 143 is disengaged from the fixed block 130, the second guide rail 142 is freely moved in a lengthwise direction thereof. To the contrary, when the screw 143 is engaged with the fixed block 130, the movement of the second guide rail 142 is restricted. Accordingly, the position of the stopper 140 to which the front end of the second guide rail 142 is fixedly mounted is determined depending on the fixed position of the second guide rail 142.

In the meantime, the clamp 163 is fixedly mounted to the front end of the first lever 161, so that the clamp 163 is moved downwardly to pressurize the fixed block 130 or is moved upwardly to be separated from the fixed block 130 in response to the pivoting of the first lever 161.

More specifically, a first support 165 is fixedly mounted to the fixed block 130 to correspond to the clamp 163, and the clamp 163 has a groove **163*h* formed on the bottom surface thereof so as to allow the nozzle 120** to be received therein while passing therethrough.

Also, the heater 173 is fixedly mounted to the front end of the second lever 172, so that the heater 173 is moved is moved downwardly to pressurize a second support 175 fixedly mounted to the fixed block 130 or is moved upwardly to be separated from the second support 175 in response to the pivoting of the second lever 172. The heater 173 pivots downwardly to sealingly close the entrance opening of the air injection passage 3 of the buffer packing bag 1 in a state where the injection of air into the buffer packing bag 1 has been completed.

In the meantime, an electric wire is connected to the heater 173 to heat the heater 173, and is also connected to a power supply 180 mounted at a rear portion of the main body 110. The power supply 180 serves to supply an external power source to the heater 173 so as to cause the heater 173 to generate heat.

As shown in FIG. 7, mounted to the surface of a rear portion of the main body as constructed above are a connector 181 for connection of an external power cable as one element of the power supply 180, a second coupler 182 to which an end of a hose is connected so as to allow the compressed air blown from a compressor to be blown to the nozzle 120, and a third coupler 183 to which an end of a hose is connected so as to allow air to be supplied to the first to third actuators 150, 160 and 170.

A controller for controlling the operation of the air injection apparatus according to the present invention is constructed as shown in FIG. 8.

As shown in FIG. 8, the controller 190 includes a pressure gauge 191 for indicating the pressure of air blown through the nozzle 120, a timer 193 for setting the time spent for pressurizing the entrance opening of the air injection passage 3 with the heater 173, a start button 195 for inputting a signal to allow the main body 110 to operate one time, and a reset button 197 for resetting the function of the controller 190.

The operation of the air injection apparatus as constructed above will be described hereinafter.

First, a worker disengages the angle adjustment bolt 115 from the female screw hole 107 of the hinge bracket 103 and then tilts the main body 115 to conform to the worker's height or maintains the main body 115 horizontally. Then, the worker fits the angle adjustment bolt 115 into any one of the angle adjustment holes 114 to engage the angle adjustment bolt 115 with the female screw hole 107 of the hinge bracket 103. As a result, the main body 110 is tilted or maintained horizontally so that the worker can inject air conveniently.

Also, the worker disengages the screw 143 from the fixed block 130 so as to set the position of the stopper 140 to fix the stopper 140. In this case, the stopper 140 is set in view of the size and the like of the buffer packing bag 1.

Like this, after the tilting angle of the main body 110 and the position of the stopper 140 have been adjusted so that the worker can work conveniently, the worker positions the air injection passage 3 to correspond to the nozzle 120 while grasping the buffer packing bag 1. In this state, when the worker inputs a signal through the start button 195 of the controller 190, the compressed air blown from the compressor is introduced into the nozzle 120 and is injected into the air injection passage 3 of the buffer packing bag 1 positioned in front of the nozzle 120 through the nozzle 120 so that the entrance opening of the air injection passage 3 formed of two folded vinyl sheets **3*v* is opened by the injected air (S10**).

At this time, when the first actuator 150 is operated to push the slide block 151 in a forward direction, the nozzle 120 fixed to the slide block 151 is also moved in the forward direction. Then, the air injection passage 3 is opened by the compressed air discharged through the nozzle 120. At this time, the worker checks that the nozzle 120 has advanced and then forcibly pushes the buffer packing bag 1 to the stopper 140 so as to allow the nozzle 120 to be inserted into the entrance opening of the air injection passage 3 (S20).

In this state, when the worker releases the depression of the start button 195, the controller 190 operates the second actuator 160. Then, as the second actuator 160 is stretched upwardly, the first lever 161 pivots so that the clamp 163 fixedly mounted to the front end of the first lever 161 is moved downwardly. Thereafter, the downwardly moved clamp 163 pressurizes the nozzle 120 inserted into the air injection passage 3 of the buffer packing bag 1 so as to clamp the vinyl sheets of the air injection passage 3. In this case, the nozzle 120 is fitted into a groove **163*h* formed on the bottom surface of the clamp 163 so that two vinyl sheets 3*v* are interposed between the clamp 163 and the first support 165 so as to prevent the air injected into the air injection passage 3 from leaking to the outside of the air injection passage 3 (S130**).

In this manner, as the compressed air is introduced into the air injection passage 3 of the buffer packing bag 1, the buffer packing bag 1 is inflated. Also, as the air is fully filled into the buffer packing bag 1, the internal pressure of the buffer packing bag 1 increases. If the internal pressure of the buffer packing bag 1 increases to a pressure value set in the controller 190, the controller 190 interrupts the injection of the air into the air injection passage 3.

If the injection of the air into the air injection passage 3 is interrupted, the controller 190 operates the third actuator 170 to cause the third actuator 170. Prior to the operation of the third actuator 170, the heater 173 is supplied with electric power from the power supply 180 so that the heater 173 maintains the temperature at which the vinyl sheets **3*v* of the air injection passage 3 can be heat-boned to each other. In a state where the heater 173 is heated, when the third actuator 170 is operated, the heater 173 mounted to the front end of the second lever 172 is moved downwardly while the second lever 172 pivots. In this case, the nozzle 120 is positioned at a point where it does not interfere with the heater 173**.

In the meantime, the heater 173 is moved downwardly, so that two vinyl sheets **3*v* of the air injection passage 3 clamped by the clamp 163 are heat-bonded at a point where the heater 173 contacts with the two vinyl sheets 3*v* (S40). The entrance opening of the air injection passage 3 is sealingly closed by the heat-bonding. In this case, the time spent for pressurization of the two vinyl sheets 3v by the heater 173 is set in the timer 193 of the controller 190**.

In this manner, since the entrance opening of the air injection passage 3 is sealingly closed, the air injected into the buffer packing bag 1 is prevented from leaking to the outside. Even though the air injected into the buffer packing bag 1 leaks to be filled into the air injection passage, the internal pressure of the air injection passage increases so that the discharge of air from the air inflatable columns is suppressed as well as the inflated air injection passage can perform a buffer function.

In the meantime, when the air injection passage 3 is sealed by the heater 173, the first actuator 150, the second actuator 160 and the third actuator 170 returns to their original positions, so that the nozzle 120 is moved backwardly to be withdrawn from the air injection passage 3 (S50). At this time, the clamp 163 and the heater 173 are moved upwardly while the first lever 161 and the second lever 172 pivot.

Although it has been described that the start button 195 is mounted to the controller 190 as shown in FIG. 8, the start button 195 may be constructed in the form of a foot switch for the convenience of the input of a signal.

In addition, the aforementioned air injection apparatus 100 is constructed to be operated through the one-time depression and the one-time release of the depression. Alternatively, the air injection apparatus 100 may be constructed such that the third actuator 170 is operated by the signal input by the start button 195 in view of the importance of a process of sealing the air injection passage 3 with the heater 173 after checking the internal pressure of the air injection passage 3.

Further, it has been described that the aforementioned air injection apparatus 100 is constructed such that the second support 175 is positioned to correspond to the heater 173. Alternatively, the air injection apparatus 100 may be constructed such that the second support 175 is replaced with the heater so as to upwardly and downwardly pressurize the air injection passage 3 to heat-bond the two vinyl sheets of the air injection passage 3.

As described above, the air injection apparatus for a buffer packing bag according to the present invention has an advantageous effect that after a worker forcibly pushes the air injection passage of the buffer packing bag to the inside of the clamp while grasping both sides of the air injection passage, when the worker operates the air injection apparatus, the injection of air into the air injection passage is automatically performed, thereby improving convenience of the work.

In addition, the air injection apparatus for a buffer packing bag according to the present invention has an advantageous effect that when the entrance opening of the air injection passage of the buffer packing bag is opened by the compressed air injected through the nozzle, the air injection passage is just fitted around the nozzle, so that the inconvenience of having to finding out the entrance opening of the air injection passage in the prior art can be avoided.

Moreover, the air injection apparatus for a buffer packing bag according to the present invention has an advantageous effect that the entrance opening of the air injection passage is sealingly closed immediately after the completion of the injection of the air, so that the leakage of the air filled into the buffer packing bag is prevented completely, thereby enhancing durability of the buffer packing bag. Furthermore, even though the air is leaked from the air inflatable columns after the lapse of a long period of time, the leaked air is stored in the air injection passage to cause the air injection passage to be inflated, so that the inflated air injection passage can perform a buffer function like the air inflatable columns.

Besides, the air injection apparatus for a buffer packing bag according to the present invention enables the measurement of the internal pressure of the buffer packing bag into which the air is filled so as to inject a proper amount of air into the buffer packing bag. Thus, even ordinary persons other than experts can easily inject air into the buffer packing bag.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. An air injection apparatus for a buffer packing bag, the apparatus comprising:

a nozzle adapted to be inserted into an entrance opening of an air injection passage of the buffer packing bag positioned at a front side of the air injection apparatus so as to inject air into the entrance opening of the air injection passage, wherein the nozzle is connected to a first actuator so that the nozzle is moved forwardly and backwardly by means of the operation of the first actuator;

a clamp adapted to pressurize the entrance opening of the air injection passage in a state where the nozzle has been inserted into the entrance opening of the air injection passage so as to prevent the air from leaking to the outside via the entrance opening;

a second actuator adapted to driven to cause the clamp to pressurize the entrance opening of the air injection passage;

a heater adapted to pressurize and heat-bond the entrance opening of the air injection passage; and a third actuator adapted to move the heater to the entrance opening of the air injection passage.

2. The air injection apparatus according to claim 1, wherein the clamp has a groove formed on the bottom surface thereof, so that when the entrance opening of the air injection passage is pressurized by the clamp, the nozzle is positioned in the groove, and any one of the vinyl sheets of the air injection passage is clamped between the nozzle and the clamp.

3. The air injection apparatus according to claim 1, further comprising:

a bottom portion on which the second actuator is positioned;

a fixed block positioned in front of the second actuator; and a first lever mounted at a front end thereof to the clamp and mounted at a rear end thereof to the second actuator, the first lever being coupled at an intermediate portion thereof to the fixed block by means of a hinge pin.

4. The air injection apparatus according to claim 3, further comprising:

a second lever mounted at a front end thereof to the heater and mounted at a rear end thereof to the third actuator, the second lever being coupled at an intermediate portion thereof to the fixed block by means of a hinge pin.

5. The air injection apparatus according to claim 4, wherein the first actuator is mounted on the bottom portion so as to be connected to a slide block movable forwardly and backwardly, the nozzle is fixedly mounted to the slide block, and a first coupler for connection of a hose is fixedly mounted to the rear end of the nozzle.

6. The air injection apparatus according to claim 4, wherein a guide rail is fixedly mounted at a front end thereof to a stopper while penetrating through the fixed block, and a screw is engaged with a side of the fixed block so as to restrict the movement of the guide rail to determine the position of the stopper.

7. The air injection apparatus according to claim 4, wherein a guide rail is fixedly mounted to the fixed block while penetrating through the slide block, so that the slide block is moved forwardly and backwardly along the guide rail.

8. The air injection apparatus according to claim 4, wherein the bottom portion is coupled to the hinge bracket positioned therebelow by means of a hinge pin so that a front end of the bottom portion pivots in a vertical direction about the hinge pin.

9. The air injection apparatus according to claim 4, wherein the bottom portion is surrounded by a case having a plurality of angle adjustment holes formed on a side thereof, and the hinge bracket has a female screw hole formed on a side thereof to correspond to any one of the plurality of angle adjustment holes of the case, so that an angle adjustment bolt is engaged with the female screw hole of the hinge bracket while passing through the any one angle adjustment hole.

* * * * *